US009477183B2

(12) United States Patent
Kurita et al.

(10) Patent No.: US 9,477,183 B2
(45) Date of Patent: Oct. 25, 2016

(54) IMAGE FORMING APPARATUS AND IMAGE FORMING SYSTEM

(71) Applicant: FUJI XEROX CO., LTD., Tokyo (JP)

(72) Inventors: Atsumi Kurita, Kanagawa (JP); Masayoshi Nakao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/699,133

(22) Filed: Apr. 29, 2015

(65) Prior Publication Data

US 2016/0085186 A1 Mar. 24, 2016

(30) Foreign Application Priority Data

Sep. 24, 2014 (JP) ..... 2014-193533

(51) Int. Cl.
*G03G 15/20* (2006.01)

(52) U.S. Cl.
CPC ..... *G03G 15/2035* (2013.01); *G03G 15/2071* (2013.01); *B65H 2511/528* (2013.01); *B65H 2601/255* (2013.01); *G03G 2215/00223* (2013.01); *G03G 2215/00455* (2013.01)

(58) Field of Classification Search
CPC ..... G03G 15/2028; G03G 15/2071; G03G 15/164; G03G 15/6517–15/6529; G03G 2215/00455; G03G 2215/00459; B65H 2404/1451; B65H 2511/528; B65H 2601/11; B65H 2601/255
See application file for complete search history.

(56) References Cited

U.S. PATENT DOCUMENTS 5,692,230 A * 11/1997 Yoshiuchi ..... G03G 15/6523 399/21
6,011,936 A * 1/2000 Kaneko ..... G03G 15/60 399/124
6,775,486 B2 * 8/2004 Matsuyama ..... G03G 15/70 399/18
8,047,539 B2 * 11/2011 Fujita ..... B65H 5/062 271/225
2011/0262153 A1 * 10/2011 Kurasawa ..... B41J 11/006 399/21
2014/0016972 A1 * 1/2014 Seshita ..... G03G 15/2064 399/329
2014/0153966 A1 * 6/2014 Tanaka ..... G03G 15/2028 399/122
2015/0355591 A1 * 12/2015 Fukai ..... G03G 15/70 399/21

FOREIGN PATENT DOCUMENTS

JP 02-162068 A 6/1990

OTHER PUBLICATIONS

Machine translation of Japanese patent document JP2015-232644, publication of Japanese patent application JP2014-119649, published Dec. 24, 2014.*

* cited by examiner

*Primary Examiner* — David Gray
*Assistant Examiner* — Carla Therrien
(74) *Attorney, Agent, or Firm* — Sughrue Mion, PLLC

(57) ABSTRACT

An image forming apparatus includes a transport module that is capable of being pulled out from an apparatus body of the image forming apparatus and in which a transport path along which a recording material, to which a toner image has been transferred, is to be transported is formed and a fixing unit that is provided in the transport module and that includes a fixing member, which fixes the toner image onto the recording material, and a pressure member, which forms a pressing part to which the recording material is to be transported between the fixing member and the pressure member. When the recording material whose length in a transport direction is longer than that of the transport module is present in the transport path, the transport module is pulled out from the apparatus body while the recording material is being nipped by the fixing member and the pressure member.

20 Claims, 4 Drawing Sheets

IMAGE FORMING APPARATUS AND IMAGE FORMING SYSTEM

CROSS-REFERENCE TO RELATED APPLICATIONS

This application is based on and claims priority under 35 USC 119 from Japanese Patent Application No. 2014-193533 filed Sep. 24, 2014.

BACKGROUND (i) Technical Field

The present invention relates to an image forming apparatus and an image forming system.

(ii) Related Art

As an example of the related art, there is an image forming apparatus that forms an image on a continuous sheet such as a roll sheet or continuous-form paper.

In an image forming apparatus, a paper jam that is a phenomenon in which a recording material becomes jammed in a transport path of a transport module, along which recording materials are to be transported, may sometimes occur in, for example, an image forming operation. In the case where such a paper jam occurs in an image forming apparatus, in order to continue an image forming operation, a recording material that has become jammed needs to be removed from the image forming apparatus. An example of a method for removing a recording material, which has become jammed, from a transport module is to pull out the transport module from an apparatus body of the image forming apparatus.

In an image forming apparatus that forms an image on a recording material such as a continuous sheet or a sheet having a long length, the recording material having a length in a transport direction longer than that of a transport module, in the case where a paper jam occurs in the transport module, the ends of the recording material are respectively positioned upstream and downstream of the transport module. Thus, for example, when the transport module is pulled out from an apparatus body in a state where the recording material is not clamped by a fixing member and a pressure member that are provided in the transport module, there is a case where the recording material is pulled out toward the side on which the apparatus body is present and rubbed against the fixing member or the pressure member. In the case where the recording material is rubbed against the fixing member or the pressure member, there is a probability that scratches will be formed on a surface of the fixing member or the pressure member.

SUMMARY

According to an aspect of the invention, there is provided an image forming apparatus including a transport module that is capable of being pulled out from an apparatus body of the image forming apparatus and in which a transport path along which a recording material, to which a toner image has been transferred, is to be transported is formed and a fixing unit that is provided in the transport module and that includes a fixing member, which fixes the toner image onto the recording material, and a pressure member, which forms a pressing part to which the recording material is to be transported between the fixing member and the pressure member. In the case where the recording material whose length in a direction in which the recording material is to be transported is longer than a length of the transport module is present in the transport path, the transport module is pulled out from the apparatus body in a state where the recording material is nipped by the fixing member and the pressure member.

BRIEF DESCRIPTION OF THE DRAWINGS

An exemplary embodiment of the present invention will be described in detail based on the following figures, wherein.

DETAILED DESCRIPTION (Image Forming System)

An exemplary embodiment of the present invention will be described in detail below with reference to the accompanying drawings.

Figure 1:
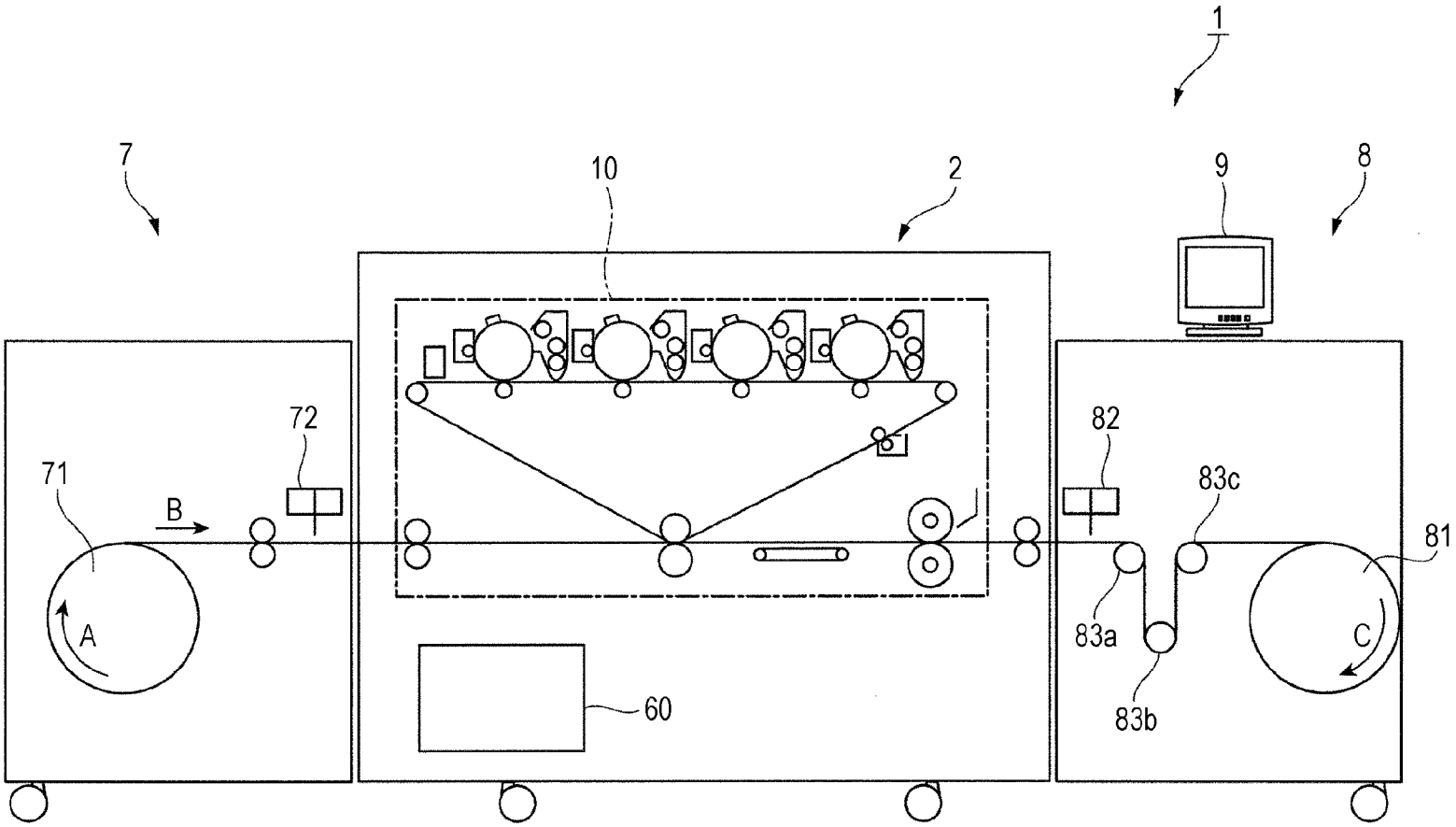
FIG. 1 is a diagram illustrating an example of the overall configuration of an image forming system according to the exemplary embodiment.

FIG. 1 is a diagram illustrating an example of the overall configuration of an image forming system 1 according to the present exemplary embodiment.

As illustrated in FIG. 1, the image forming system 1 includes an image forming apparatus 2 that includes an image forming unit 10 and that forms an image on a continuous sheet (web), which is used as an example of a recording material on which an image is to be formed, a sheet feed device 7 that feeds the continuous sheet to the image forming apparatus 2, and a collecting device 8 that collects the continuous sheet on which an image has been formed by the image forming apparatus 2. In addition, the image forming system 1 includes a user interface (UI) 9 that is formed of a display panel and the like and that is configured to receive information from a user and display information for a user.

In the image forming system 1 according to the present exemplary embodiment, as the continuous sheet on which an image is to be formed, a film made of, for example, polypropylene (PP), polyethylene terephthalate (PET), or the like, an adhesive sheet formed by stacking a sheet having an adhesive surface and a releasable sheet, or the like may be used as well as a normal sheet.

Although one image forming apparatus 2 is disposed between the sheet feed device 7 and the collecting device 8 in the image forming system 1 illustrated in FIG. 1, for example, two or more image forming apparatuses 2 may be disposed in series, and in addition, the image forming system 1 may include an inversion device (not illustrated) that inverts the front and rear surfaces of the continuous sheet, a subsequent processing device (not illustrated) that performs subsequent processing on the continuous sheet on which an image has been formed, and the like.

(Sheet Feed Device)

The sheet feed device 7 according to the present exemplary embodiment feeds the continuous sheet (web), which is rolled, to the image forming apparatus 2 while reeling out the continuous sheet. More specifically, the sheet feed device 7 includes a roller 71 that supports the continuous sheet and that is rotatable. In the sheet feed device 7, the rolled continuous sheet is reeled out as a result of the roller 71 rotating in the direction of arrow A and is transported in the direction of arrow B in such a manner as to be fed into the image forming apparatus 2.

In addition, the sheet feed device 7 according to the present exemplary embodiment includes an upstream-side cutting device 72 that cuts the continuous sheet, which has been sent out from the roller 71, at a position upstream of the image forming apparatus 2. Although details of the upstream-side cutting device 72 will be described later, the upstream-side cutting device 72 cuts the continuous sheet, which has been sent out from the roller 71, at a predetermined timing along a direction (width direction of the continuous sheet) perpendicular to the direction in which the continuous sheet is transported.

(Collecting Device)

The collecting device 8 according to the present exemplary embodiment collects the continuous sheet, on which an image has been formed by the image forming apparatus 2, while reeling in the continuous sheet. More specifically, the collecting device 8 includes a roller 81 that is rotatable. The rolled continuous sheet, which is discharged from the image forming apparatus 2, is rolled up by the roller 81 as a result of the roller 81 rotating in the direction of arrow C.

The collecting device 8 according to the present exemplary embodiment includes a downstream-side cutting device 82 that cuts the continuous sheet, which has been discharged from the image forming apparatus 2, at a position downstream of the image forming apparatus 2. Although details of the downstream-side cutting device 82 will be described later, the downstream-side cutting device 82 cuts the continuous sheet, which has been discharged from the image forming apparatus 2 and transported to the collecting device 8, at a predetermined timing along the direction perpendicular to the direction in which the continuous sheet is transported.

In addition, the collecting device 8 according to the present exemplary embodiment includes adjustment rollers 83*a* to 83*c* that are used for adjusting the amount of slackness of the continuous sheet. The adjustment rollers 83*a* to 83*c* are rotatably supported and configured to be movable in a direction that crosses the direction in which rotation axes thereof extend. In the collecting device 8, as a result of movement of at least one of the adjustment rollers 83*a* to 83*c*, the amount of slackness of the continuous sheet during the period from when the continuous sheet is discharged from the image forming apparatus 2 until the continuous sheet is rolled up by the roller 81.

Note that the collecting device 8 may collect the continuous sheet while, for example, cutting the continuous sheet by using the downstream-side cutting device 82 and stacking the cut sheets, which are obtained by cutting the continuous sheet, or folding the continuous sheet in which perforations, along each of which one sheet may be separated from the continuous sheet, are formed along the perforations instead of rolling up the continuous sheet as in the present exemplary embodiment.

(Image Forming Apparatus)

Figure 2:
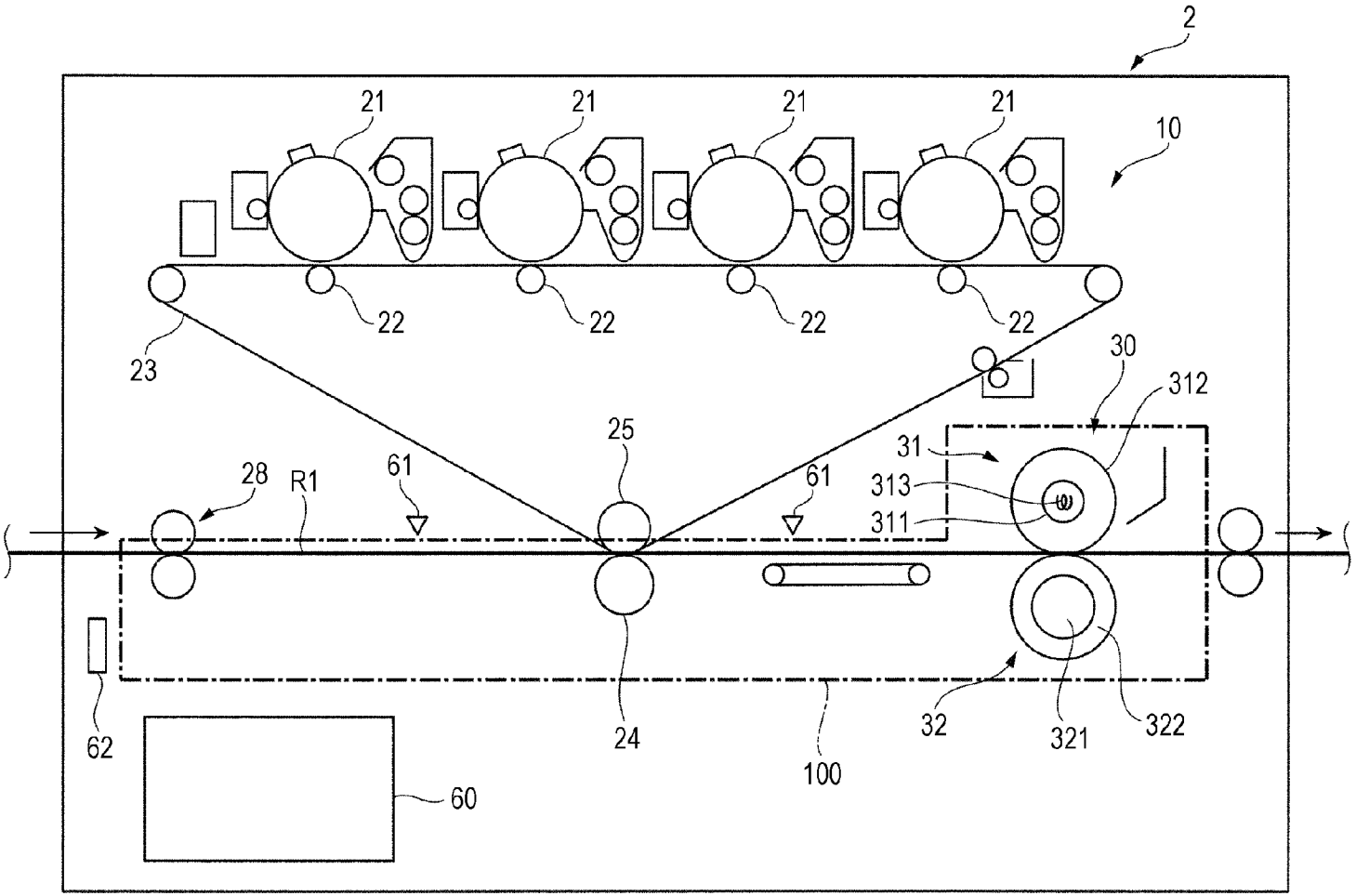
FIG. 2 is a diagram illustrating an image forming apparatus according to the exemplary embodiment.

FIG. 2 is a diagram illustrating the image forming apparatus 2 according to the present exemplary embodiment and corresponding to a diagram illustrating the image forming apparatus 2 as seen from the front.

The image forming apparatus 2 according to the present exemplary embodiment employs a so-called tandem system and includes four photoconductor drums 21 each of which corresponds to one of colors black (K), yellow (Y), magenta (M), and cyan (C) and that are arranged in parallel in the horizontal direction, four first transfer rollers 22 disposed in such a manner as to correspond to the photoconductor drums 21, an intermediate transfer belt 23 onto which toner images formed on the photoconductor drums 21 are to be sequentially transferred, a second transfer roller 24 that is an example of a rotary member and that transfers toner images, which have been transferred to the intermediate transfer belt 23 in a first transfer process, onto the continuous sheet in a second transfer process, and a backup roller 25 that is disposed in such a manner as to face the second transfer roller 24 with the intermediate transfer belt 23 interposed therebetween. In the present exemplary embodiment, the second transfer roller 24 is pressed against the backup roller 25 with the intermediate transfer belt 23 interposed therebetween. In the image forming apparatus 2 according to the present exemplary embodiment, the second transfer roller 24 is capable of being released from the state of being pressed against the backup roller 25.

In addition, the image forming apparatus 2 includes transport rollers 28 that transport the continuous sheet, which is fed to the image forming apparatus 2 from the sheet feed device 7, toward an area (second transfer section) in which the second transfer roller 24 and the backup roller 25 face each other.

Furthermore, the image forming apparatus 2 includes a fixing device 30 that is an example of a fixing unit that fixes toner images, which have been transferred to the continuous sheet in the second transfer process, onto the continuous sheet.

The following components are disposed around the periphery of each of the photoconductor drums 21: a charger that charges a surface of the photoconductor drum 21, a laser writing device that forms an electrostatic latent image on the surface of the photoconductor drum 21, which has been charged by the charger, by laser beam irradiation, a developing unit that visualizes the electrostatic latent image formed on the photoconductor drum 21 by developing the electrostatic latent image with a toner of the corresponding color, a cleaner that removes residual toner on the photoconductor drum 21 after the first transfer process, and the like.

Each of the first transfer rollers 22 is disposed in such a manner as to face the corresponding photoconductor drum 21 with the intermediate transfer belt 23 interposed therebetween. Each of the first transfer rollers 22 is configured to transfer a toner image formed on the corresponding photoconductor drum 21 onto the intermediate transfer belt 23 in the first transfer process. The intermediate transfer belt 23 is stretched by plural support rollers.

The second transfer roller 24 is disposed in such a manner as to face the intermediate transfer belt 23 and is pressed against the backup roller 25 with the intermediate transfer belt 23 interposed therebetween. A second-transfer bias (second-transfer electric field) is generated between the second transfer roller 24 and the backup roller 25. The second transfer roller 24 transfers in a second transfer process (collectively transfers) toner images of different colors, which have been sequentially transferred to the intermediate transfer belt 23 in the first transfer process, onto the continuous sheet while transporting the continuous sheet by rotating in a predetermined direction (second direction, which is a clockwise direction in FIG. 2).

In the image forming apparatus 2 according to the present exemplary embodiment, the second transfer roller 24, the fixing device 30, and the transport rollers 28 are disposed in the same housing (not illustrated), so that a transport module 100 is formed. In the image forming apparatus 2 according to the present exemplary embodiment, a continuous-sheet-transport path R1 that is an example of a transport path along which the continuous sheet is to be transported is formed in the transport module 100. In the transport module 100, the transport rollers 28, the second transfer roller 24, and the fixing device 30 are disposed in this order starting from an upstream side to a downstream side of the transport path R1.

The transport module 100 is arranged in such a manner as to be movable with respect to an apparatus body of the image forming apparatus 2 by a guide rail (not illustrated) or the like and is capable of being pulled outside the image forming apparatus 2. In the present exemplary embodiment, the transport module 100 is capable of being pulled toward a front side of the image forming apparatus 2 (the proximal side as viewed in FIG. 2).

In the image forming apparatus 2 according to the present exemplary embodiment, for example, when a paper jam that is a phenomenon in which the continuous sheet becomes jammed in the continuous-sheet-transport path R1 occurs or when maintenance of the image forming apparatus 2 is performed, the transport module 100 is pulled out from the apparatus body of the image forming apparatus 2.

The image forming apparatus 2 further includes a controller 60 that controls the entire operation of the image forming system 1. The controller 60 is formed of a central processing unit (CPU), a read only memory (ROM), a random access memory (RAM), and a hard disk drive (HDD), each of which is not illustrated. The CPU executes processing programs. Various programs, tables, parameters, and the like are stored in the ROM. The RAM is used as a work area or the like when the CPU executes various programs.

The image forming apparatus 2 further includes at least one continuous-sheet sensor 61 that is an example of a sensing unit that senses a transport position of the continuous sheet, the continuous sheet, which has become jammed (paper jam), and the like in the image forming apparatus 2. In the present exemplary embodiment, the at least one continuous-sheet sensor 61 is formed of, for example, a photosensor and senses the transport position of the continuous sheet by sensing a mark for position sensing that is formed on the continuous sheet. The at least one continuous-sheet sensor 61 includes plural continuous-sheet sensors 61, and the continuous-sheet sensors 61 are disposed in the transport module 100. For example, in the case where the mark for position sensing of the continuous sheet is not sensed by the continuous-sheet sensors 61 at a predetermined timing, it is determined by the controller 60 that a paper jam has occurred at a position upstream of the continuous-sheet sensors 61.

The image forming apparatus 2 further includes a pulled-state sensor 62 (described later) that senses whether the transport module 100 has been pulled out.

(Fixing Device)

The fixing device 30 according to the present exemplary embodiment includes a fixing roller 31 that is an example of a fixing member and a pressure roller 32 that is disposed in such a manner as to face the fixing roller 31 and that forms a nip part (pressing part), through which the continuous sheet passes, between the fixing roller 31 and the pressure roller 32. The pressure roller 32 is an example of a pressure member.

The fixing roller 31 includes a core bar 311 made of a metal such as aluminum or iron and having a cylindrical shape and a surface release layer 312 made of a fluorocarbon resin or the like and covering the outer circumferential surface of the core bar 311. The surface release layer 312 suppresses deposition of offset toners and paper dust from the continuous sheet. In addition, the fixing roller 31 includes a heater 313 that is disposed in an area inside the core bar 311 and that heats the core bar 311 of the fixing roller 31. For example, a halogen lamp or the like may be used as the heater 313.

The pressure roller 32 includes a shaft 321 that is made of a metal such as stainless steel or iron and that has a solid columnar shape and an elastic layer 322 that has a cylindrical shape and that is disposed over the periphery of the shaft 321, the elastic layer 322 being formed of a member that is made of a silicone rubber or the like and that deforms when pressed.

In the fixing device 30 according to the present exemplary embodiment, the fixing roller 31 is driven so as to rotate in one direction (a counterclockwise direction in FIG. 2) at a predetermined speed while having a rotation axis extending in the longitudinal direction of the fixing roller 31. Along with rotation of the fixing roller 31, the pressure roller 32, which is disposed in such a manner as to be in contact with the fixing roller 31, is driven and rotates in one direction (the clockwise direction in FIG. 2) in such a manner as to follow the movement of the fixing roller 31. In other words, the pressure roller 32 rotates in conjunction with the fixing roller 31 as a result of receiving a force that drives the pressure roller 32 so as to rotate from the fixing roller 31.

The fixing device 30 according to the present exemplary embodiment is configured to be capable of switching, under control of the controller 60, its state between a pressed state in which the pressure roller 32 is pressed against the fixing roller 31, so that the nip part is formed between the fixing roller 31 and the pressure roller 32 and a released state in which the pressure roller 32 is released from being pressed against the fixing roller 31, so that the fixing roller 31 and the pressure roller 32 are spaced away from each other.

(Image Forming Operation)

An image forming operation that is to be performed in the image forming system 1 according to the present exemplary embodiment will now be described. The image forming operation, which will be described below, is performed under control of the controller 60.

Upon start of the image forming operation, the controller 60 performs image processing on image data generated by a personal computer (not illustrated) or the like. In addition, the photoconductor drums 21 and the intermediate transfer belt 23 start rotating by being controlled by the controller 60. Furthermore, in the fixing device 30, driving of the fixing roller 31 is started, and power supply to the heater 313 of the fixing roller 31 is started.

Then, the surfaces of the photoconductor drums 21 are charged by the corresponding chargers so as to have a predetermined potential and exposed with laser beams by the laser writing devices on the basis of the image data, on which the image processing has been performed. Consequently, electrostatic latent images of different colors are formed on the photoconductor drums 21. The electrostatic latent images formed on the photoconductor drums 21 are developed by the corresponding developing units, so that toner images of black (K), yellow (Y), magenta (M), and cyan (C) are formed on the corresponding photoconductor drums 21.

The toner images of the different colors, which have been formed on the photoconductor drums 21, are transferred onto the intermediate transfer belt 23, which moves, by being sequentially and electrostatically attracted to the first transfer rollers 22, and a combined toner image that is formed by superposing the toner images of the different colors with one another is formed. The combined toner image on the intermediate transfer belt 23 is transported to the position at which the second transfer roller 24 is disposed (second transfer section) along with movement of the intermediate transfer belt 23.

Then, when the combined toner image is transported to the second transfer section, the continuous sheet is transported toward the second transfer roller 24 by the sheet feed device 7 (see FIG. 1) and the transport rollers 28 in accordance with the timing at which the combined toner image is transported to the second transfer section. Accordingly, the combined toner image is electrostatically transferred onto a predetermined portion of the continuous sheet owing to the influence of a transfer electric field, which is formed between the second transfer roller 24 and the backup roller 25.

Next, the portion of the continuous sheet, to which the combined toner image has been transferred in a second transfer process, is transported by the second transfer roller 24, which rotates, and separated from the intermediate transfer belt 23. After that, the portion of the continuous sheet is transported to the fixing device 30. In the fixing device 30, the fixing roller 31 and the pressure roller 32 performs a fixing treatment on the portion of the continuous sheet by applying heat and pressure to the portion of the continuous sheet, and the combined toner image is fixed onto the continuous sheet, so that a color image is formed on the continuous sheet.

After that, the portion of the continuous sheet, on which the color image has been formed, is transported as a result of rotation of the fixing roller 31, is discharged from the image forming apparatus 2, and is collected by the roller 81 (see FIG. 1) of the collecting device 8 (see FIG. 1) by being rolled up by the roller 81.

Here, focusing on transportation of the continuous sheet in the transport module 100 during the image forming operation, in the image forming system 1 according to the present exemplary embodiment, the continuous sheet, which has been fed to the image forming apparatus 2 by the sheet feed device 7, is transported along the continuous-sheet-transport path R1 of the transport module 100 from the left side in FIG. 2 to the right side in FIG. 2 as a result of rotations of the second transfer roller 24, the fixing roller 31, and the transport rollers 28.

(Problems when Paper Jam Occurs)

In the image forming apparatus 2 according to the present exemplary embodiment, for example, during the period when an image forming operation is performed on the continuous sheet, a failure during transportation of the continuous sheet may sometimes occur. Such a failure is, for example, a so-called paper jam, which is a phenomenon in which the continuous sheet becomes jammed in the continuous-sheet-transport path R1 of the transport module 100. In the case where a paper jam occurs in the image forming apparatus 2, in order to resume the image forming operation, it is necessary to clear the paper jam by removing a sheet that has become jammed. However, in the image forming apparatus 2 in which the continuous sheet is used, it is difficult to remove a sheet (continuous sheet) that has become jammed compared with the case where a cut sheet is used.

In other words, in the case where a cut sheet has become jammed in an image forming apparatus, a paper jam may be cleared by, for example, pulling out the jammed cut sheet from the upstream or downstream side of an area in which the paper jam has occurred. On the other hand, in the image forming apparatus 2, which forms an image on the continuous sheet, it is difficult to pull out the continuous sheet that is continuous with the sheet feed device 7 or the collecting device 8 even if, for example, the continuous sheet is pulled from the upstream or downstream side of the image forming apparatus 2, and thus, it is difficult to clear a paper jam.

Therefore, in the image forming apparatus 2, which forms an image on the continuous sheet, in the case where a jam of the continuous sheet has occurred, the continuous sheet, which has become jammed, needs to be removed by pulling out the transport module 100 from the image forming apparatus 2.

As described above, in the image forming apparatus 2, which forms an image on the continuous sheet, during the period when an image forming operation is performed, the upstream portion of the continuous sheet, which is transported in the transport module 100 of the image forming apparatus 2, is connected to the sheet feed device 7, and the downstream portion of the continuous sheet is connected to the collecting device 8.

Figure 3:
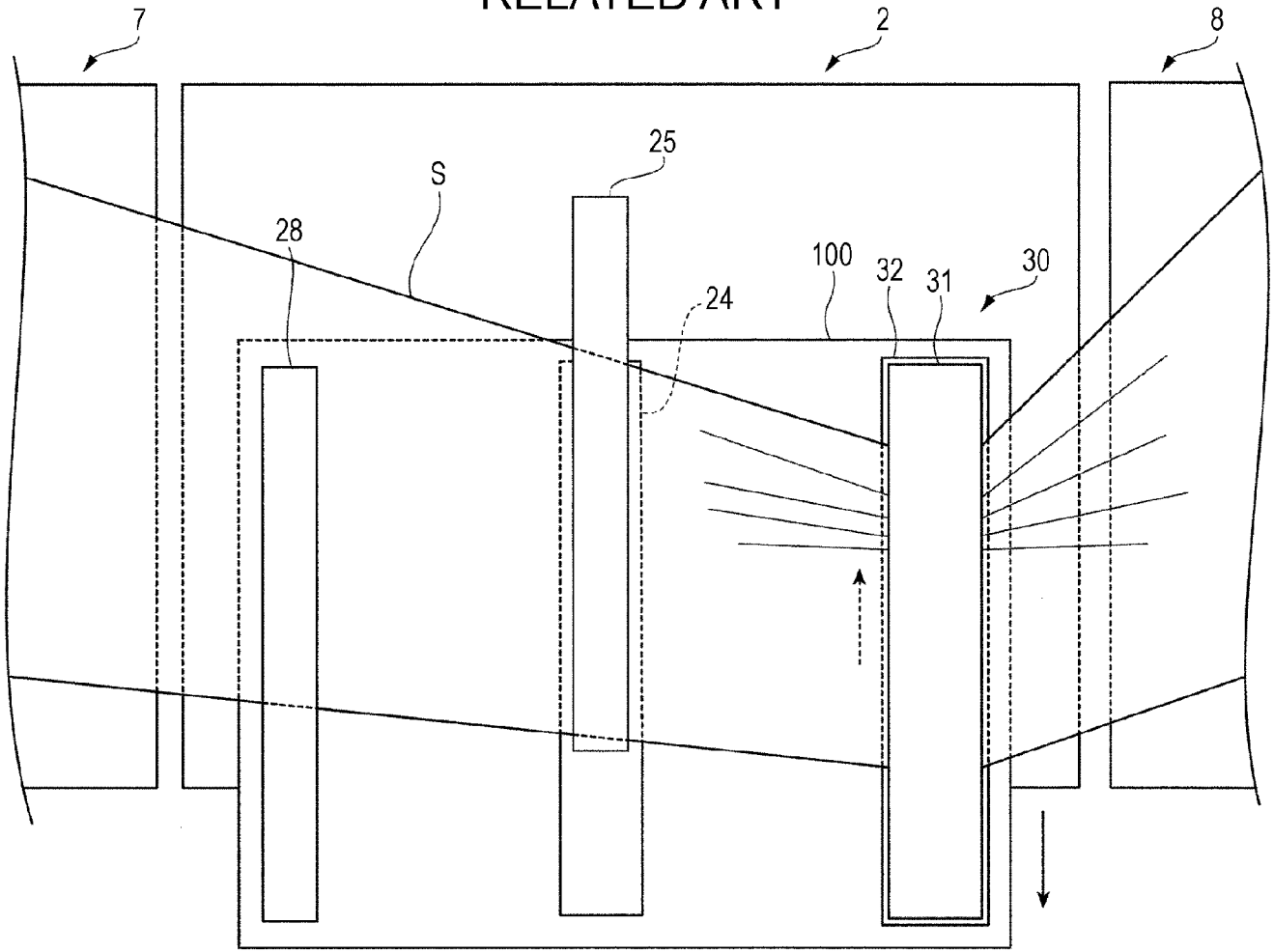
FIG. 3 RELATED ART
FIG. 3 is a diagram illustrating a state where a transport module has been pulled out from an apparatus body of an image forming apparatus in an image forming system of the related art.

FIG. 3 is a diagram illustrating a state where a transport module 100 has been pulled out from an apparatus body of an image forming apparatus 2 in an image forming system 1 of the related art in a state where the ends of a continuous sheet are respectively connected to a sheet feed device 7 or a collecting device 8. Note that FIG. 3 corresponds to a diagram illustrating the image forming system 1 as seen from above.

In a state where the ends of the ends of a continuous sheet S are respectively connected to the sheet feed device 7 or the collecting device 8, when the transport module 100 is forcibly pulled out from the apparatus body of the image forming apparatus 2, a tension is exerted on the continuous sheet S by the sheet feed device 7 and the collecting device 8, and the continuous sheet S moves relative to the transport module 100 to the side on which the apparatus body of the image forming apparatus 2 is present as indicated by a dashed arrow in FIG. 3. Accordingly, as illustrated in FIG. 3, the continuous sheet S is in a state of being pulled to a rear surface side (rear side) of the image forming apparatus 2 between the fixing roller 31 and the pressure roller 32 of the fixing device 30. In this case, the continuous sheet S is rubbed against the fixing roller 31 and the pressure roller 32, so that there is a probability that scratches and the like may be formed on surfaces of the fixing roller 31 and the pressure roller 32. In particular, the surface release layer 312 made of a fluorocarbon resin or the like is formed on the surface of the fixing roller 31. In general, a fluorocarbon resin has a property of being soft and a property of being easily damaged by friction, and thus, scratches are likely to be formed on the surface of the fixing roller 31 as a result of the continuous sheet S being rubbed against the fixing roller 31.

In addition, in the case where the transport module 100 is forcibly pulled out from the apparatus body of the image forming apparatus 2, the continuous sheet S is in a state of being pulled to the rear side of the image forming apparatus 2, and as a result, wrinkles may sometimes be generated in the continuous sheet S as illustrated in FIG. 3. In the case where wrinkles are generated in the continuous sheet S by forcibly pulling out the transport module 100, it becomes more difficult to remove the continuous sheet S from the transport module 100 and clear the paper jam.

In the case where wrinkles have been generated in the continuous sheet S, when the image forming operation is resumed in the image forming apparatus 2, a portion of the continuous sheet S in which wrinkles have been generated needs to be cut off and removed. In this case, a large portion of the continuous sheet S may sometimes go to waste, and this is not desirable from the standpoint of resource costs.

(Operation when Paper Jam has Occurred)

On the other hand, in the image forming system 1 according to the present exemplary embodiment, a jam of a continuous sheet S is cleared by performing the following operation. An operation to be performed when trying to clear a paper jam in the image forming apparatus 2 according to the present exemplary embodiment will now be described. In the following description, the case where a paper jam has occurred in the continuous-sheet-transport path R1, which is formed in the transport module 100, will be described.

Figure 4:
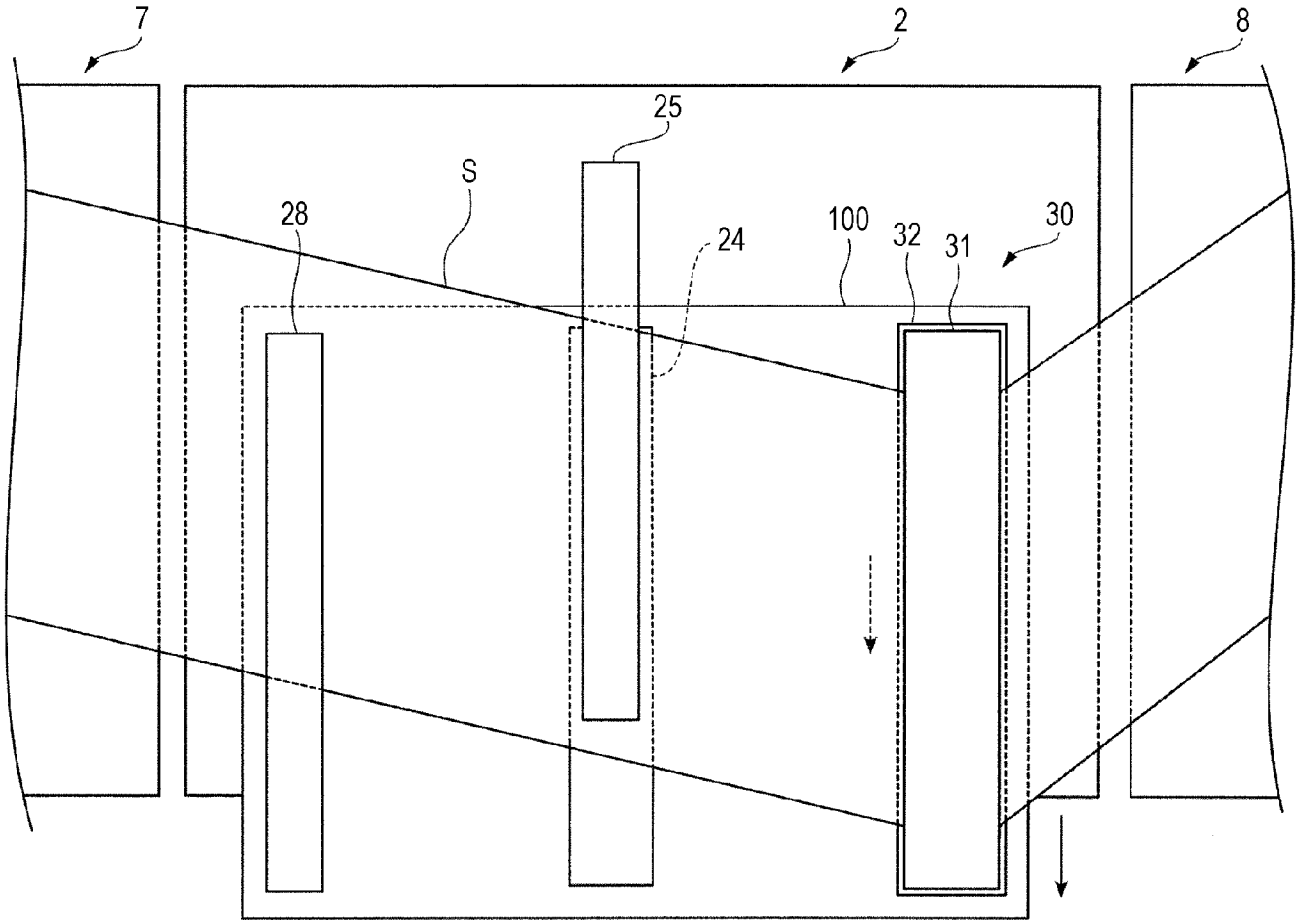
FIG. 4 is a diagram illustrating the operation of the image forming system when a paper jam has occurred.

FIG. 4 is a diagram illustrating the operation of the image forming system 1 when a paper jam has occurred. Here, FIG. 4 corresponds to a diagram illustrating the image forming system 1 as seen from above. Note that, in FIG. 4, components in the image forming apparatus 2 other than the second transfer roller 24, the backup roller 25, the transport rollers 28 and the fixing device 30 are not illustrated.

In the image forming apparatus 2, for example, in the case where a jam of the continuous sheet S is sensed by the continuous-sheet sensors 61 during the period when an image forming operation is performed, first, the image forming operation performed in the image forming apparatus 2, the operation of feeding the continuous sheet S performed by the sheet feed device 7, the operation of collecting the continuous sheet S performed by the collecting device 8, and the like are stopped under control of the controller 60.

Here, in the image forming apparatus 2, for example, the continuous-sheet sensors 61 senses a mark for position sensing formed on the continuous sheet S, and the controller 60 determines whether a paper jam has occurred and determines the position where a paper jam has occurred on the basis of the sensing results obtained by the continuous-sheet sensors 61.

In the case where the continuous-sheet sensors 61 senses a jam of the continuous sheet S during the period when the image forming operation is performed, the fixing roller 31 is made to stop rotating, and the pressed state of the fixing device 30 is switched to the released state under control of the controller 60.

Note that the state of the fixing device 30 is switched to the released state when a paper jam has occurred in order to suppress occurrence of damage to the continuous sheet S due to heat and to reduce a likelihood that the continuous sheet S will stick to the fixing roller 31 or the pressure roller 32. In other words, in the case where the fixing device 30 is kept in the pressed state when the jam of the continuous sheet S has occurred, heat from the fixing roller 31 and the pressure roller 32 is kept transferred to the same portion of the continuous sheet S. In this case, the continuous sheet S is excessively heated, and there is a probability that the continuous sheet S will become damaged, and that the continuous sheet S, which has been deformed by the heat, will stick to the surfaces of the fixing roller 31 and the pressure roller 32. Such problems are likely to occur particularly in the case where a film, a label, or the like is used as the continuous sheet S.

Then, the released state of the fixing device 30 is switched to the pressed state again under control of the controller 60. The state of the fixing device 30 is switched to the pressed state at, for example, the timing at which an operation of pulling out the transport module 100 performed by a user is sensed by the pulled-state sensor 62, or the timing at which a user inputs, through the UI 9, an instruction to clear a paper jam. Alternatively, a configuration in which after a jam of the continuous sheet S has occurred, and the state of the fixing device 30 has been switched to the released state, the state of the fixing device 30 is switched to the pressed state again after a predetermined time has passed may be employed. That is to say, in the present exemplary embodiment, after a paper jam has occurred, and the state of the fixing device 30 has been switched to the released state, the state of the fixing device 30 may be switched from the released state to the pressed state at least before the transport module 100 is pulled out from the apparatus body of the image forming apparatus 2.

Then, the state of the fixing device 30 is switched to the pressed state, so that the continuous sheet S is in a state of being nipped and pressurized by the fixing roller 31 and the pressure roller 32 of the fixing device 30.

Subsequently, in order to remove the continuous sheet S from the transport module 100 and clear the paper jam, for example, the transport module 100 is pulled out from the apparatus body of the image forming apparatus 2 toward the front side by a user. In the present exemplary embodiment, the transport module 100 is pulled out from the apparatus body of the image forming apparatus 2 in a state where the state of the fixing device 30 is set to the pressed state.

In the present exemplary embodiment, as the transport module 100 is pulled out, the fixing device 30, which is included in the transport module 100, is also moved toward the front side from the image forming apparatus 2. In the present exemplary embodiment, before the transport module 100 is pulled out, the continuous sheet S is in a state of being nipped and pressurized by the fixing roller 31 and the pressure roller 32. Consequently, as illustrated in FIG. 4, as the transport module 100 is pulled out from the image forming apparatus 2, and the fixing device 30 is moved toward the front side, the continuous sheet S, which has been nipped and pressurized by the fixing roller 31 and the pressure roller 32, is pulled out from the image forming apparatus 2 toward the front side.

As a result, in the image forming apparatus 2 according to the present exemplary embodiment, the probability that the continuous sheet S will move relative to the transport module 100 between the fixing roller 31 and pressure roller 32 when the transport module 100 is pulled out from the image forming apparatus 2 is reduced. Consequently, the probability that the continuous sheet S will be rubbed against the fixing roller 31 and the pressure roller 32 is reduced, and the probability that scratches and the like will be formed on the surfaces of the fixing roller 31 and the pressure roller 32 is reduced.

As the continuous sheet S is pulled out from the image forming apparatus 2 while being nipped by the fixing roller 31 and the pressure roller 32, the roller 71 (see FIG. 1) of the sheet feed device 7 rotates in the direction of arrow A, and the roller 81 (see FIG. 1) of the collecting device 8 rotates in a direction opposite to the direction of arrow C, so that the continuous sheet S is reeled out from the sheet feed device 7 and the collecting device 8. As a result, the occurrence of breakage of the continuous sheet S upon pulling out the transport module 100 is suppressed compared with the case where the continuous sheet S is not reeled out from the sheet feed device 7 and the collecting device 8. In addition, a force required for a user to pull out the transport module 100 is reduced.

Although, the case where the roller 71 and the roller 81 rotate in response to pulling out the transport module 100 has been described above, for example, the continuous sheet S may be slackened on the upstream and downstream sides of the transport module 100 beforehand by causing the roller 71 to rotate in the direction of arrow A and causing the roller 81 to rotate in the direction opposite to the direction of arrow C before the transport module 100 is pulled out. Alternatively, on the downstream side of the transport module 100, the continuous sheet S may be slackened beforehand by, for example, causing at least one of the adjustment rollers 83*a* to 83*c* (see FIG. 1), which are included in the collecting device 8, to move.

Also in this case, the continuous sheet S, which is slackened beforehand, is reeled out from the sheet feed device 7 and the collecting device 8 in response to pulling out the transport module 100, and thus, the occurrence of breakage of the continuous sheet S is suppressed compared with the case where the continuous sheet S is not slackened beforehand.

Next, in the case where the pulled-state sensor 62 senses that the transport module 100 has been pulled out by a predetermined distance, the state of the fixing device 30 is switched to the released state again under control of the controller 60.

After the transport module 100 has been pulled out, for example, the continuous sheet S is cut by the upstream-side cutting device 72 and the downstream-side cutting device 82 at the ends of the transport module 100. Note that a user may manually cut the continuous sheet S. After that, a portion of the continuous sheet S, which has been cut, is removed from the transport module 100 by a user, and the jam of the continuous sheet S is cleared.

In the present exemplary embodiment, in the case where a jam of the continuous sheet S has occurred in the transport module 100, the transport module 100 is pulled out from the apparatus body of the image forming apparatus 2 after switching the state of the fixing device 30 to the pressed state, and then, the continuous sheet S is cut at the ends of the transport module 100.

However, for example, a process for clearing a paper jam may be performed in the following order as long as the transport module 100 is pulled out in a state where the continuous sheet S is nipped by the fixing roller 31 and the pressure roller 32 by switching the state of the fixing device 30 to the pressed state.

In other words, first, for example, the state of the fixing device 30 is switched to the pressed state. Then, for example, the continuous sheet S is cut by the upstream-side cutting device 72 and the downstream-side cutting device 82 at the ends of the transport module 100, and after that, the transport module 100 may be pulled out while the state of the fixing device 30 is kept in the pressed state, that is, in a state where a portion of the continuous sheet S, which has been cut, is nipped by the fixing roller 31 and the pressure roller 32.

Alternatively, for example, after the continuous sheet S has been cut by the upstream-side cutting device 72 and the downstream-side cutting device 82 at the ends of the transport module 100, the state of the fixing device 30 may be switched to the pressed state, and the transport module 100 may be pulled out in a state where a portion of the continuous sheet S, which has been cut, is nipped by the fixing roller 31 and the pressure roller 32.

As described above, whether or not the continuous sheet S is cut at the ends of the transport module 100, the probability that the continuous sheet S will be rubbed against the fixing roller 31 or the pressure roller 32 is reduced by pulling out the transport module 100 from the apparatus body of the image forming apparatus 2 in a state where the continuous sheet S is nipped by the fixing roller 31 and the pressure roller 32. As a result, the probability that scratches and the like will be formed on the surfaces of the fixing roller 31 and the pressure roller 32 is reduced.

In the case where the continuous sheet S is cut at the ends of the transport module 100, the continuous sheet S is not connected to the sheet feed device 7 and the collecting device 8. Thus, in the case where the transport module 100 is pulled out from the apparatus body of the image forming apparatus 2 after the continuous sheet S has been cut at the ends of the transport module 100, it is not necessary to cause the roller 71 and the roller 81 to rotate in response to pulling out the transport module 100, and it is not necessary to slacken the continuous sheet S beforehand.

Next, after a portion of the continuous sheet S, which has become jammed, has been removed from the transport module 100, the transport module 100 is placed back into the image forming apparatus 2, and then the image forming operation is resumed. In other words, after the portion of the continuous sheet S has been removed, when the pulled-state sensor 62 senses that the transport module 100 has been placed back in the image forming apparatus 2, the sheet feed device 7 feeds the continuous sheet S to the image forming apparatus 2 again under control of the controller 60. Then, an end portion of the continuous sheet S, which is fed to the image forming apparatus 2, is rolled up by the collecting device 8 via the image forming apparatus 2, and as illustrated in FIG. 1, the image forming operation is resumed in a state where the continuous sheet S is connected to the sheet feed device 7, the image forming apparatus 2, and the collecting device 8.

In the image forming apparatus 2 according to the present exemplary embodiment, as described above, the state of the fixing device 30 is set to the pressed state when the transport module 100 is pulled out from the image forming apparatus 2, so that the probability that the continuous sheet S will be rubbed against the fixing roller 31 and the pressure roller 32 is reduced. In other words, the image forming apparatus 2 according to the present exemplary embodiment does not include a special member that is used for reducing the probability that the continuous sheet S will be rubbed against the fixing roller 31 and the pressure roller 32.

Therefore, in the present exemplary embodiment, the configuration of the image forming apparatus 2 may be simplified, and an increase in the size of the image forming apparatus 2 is suppressed compared with the case where, for example, a special member that is used for reducing the probability that the continuous sheet S will be rubbed against the fixing roller 31 and the pressure roller 32 is provided.

The operation in the case where a jam of the continuous sheet S has occurred in the transport module 100 has been described above. In the case where the transport module 100 is pulled out from the apparatus body of the image forming apparatus 2 in a state where the continuous sheet S is present in the continuous-sheet-transport path R1 (see FIG. 2) when, for example, maintenance of the image forming apparatus 2 is performed, there is a possibility that problems similar to those in the case illustrated in FIG. 3 will occur.

Accordingly, the image forming system 1 according to the present exemplary embodiment may have a configuration in which, in the case where the continuous sheet S is present in the continuous-sheet-transport path R1, the transport module 100 is pulled out from the apparatus body in a state where the state of the fixing device 30 is set to the pressed state. With this configuration, in the case where the transport module 100 is pulled out from the apparatus body when, for example, the maintenance of the image forming apparatus 2 is performed, the probability that the continuous sheet S will be rubbed against the fixing roller 31 and the pressure roller 32 is reduced, and the probability that scratches will be formed on the surfaces of the fixing roller 31 and the pressure roller 32 is reduced.

Although, in the present exemplary embodiment, the fixing device 30 of a so-called two-roll type that fixes a toner image onto a continuous sheet by using the fixing roller 31 and the pressure roller 32 is used, the configuration of the fixing device 30 is not particularly limited as long as the fixing device 30 is configured to fix a toner image onto a continuous sheet by applying heat and pressure to the continuous sheet while transporting the continuous sheet by rotating. For example, the fixing device 30 that includes, instead of the fixing roller 31 and the pressure roller 32, an endless belt member that is stretched by rollers may be used.

In addition, although the controller 60, which controls the operations of the image forming apparatus 2, the sheet feed device 7, and the collecting device 8, is provided in the image forming apparatus 2 in the present exemplary embodiment, the controller 60 may be provided in the sheet feed device 7 or the collecting device 8, or the controller 60 that is a different member from the sheet feed device 7 and the collecting device 8 may be provided. Alternatively, the image forming apparatus 2, the sheet feed device 7, and the collecting device 8 may each be provided with the controller 60 and controlled by the controller 60.

Furthermore, although the image forming apparatus 2 that forms an image on the continuous sheet (web) fed by the sheet feed device 7 has been described in the present exemplary embodiment, the present invention may be applied to an image forming apparatus that forms an image on, for example, a sheet having a long length.

In other words, in the image forming apparatus 2, in the case where an image is formed on a sheet having a long length (long sheet) whose length in a direction in which the sheet is to be transported is longer than that of the transport module 100, for example, when a paper jam has occurred in the transport module 100, the end portions of the long sheet extend from the upstream and downstream side of the transport module 100. Thus, for example, in the case where the transport module 100 is pulled out in a state where the long sheet is not nipped by the fixing roller 31 and the pressure roller 32, a problem in that the long sheet is rubbed against the fixing roller 31 or the pressure roller 32 occurs as in the above-described case where a continuous sheet is used.

However, as in the above-described case where a continuous sheet is used, by employing a configuration in which the transport module 100 is pulled out from the apparatus body of the image forming apparatus 2 in a state where the long sheet is nipped by the fixing roller 31 and the pressure roller 32, the probability that the long sheet will be rubbed against the fixing roller 31 or the pressure roller 32 is reduced, and the probability that scratches will be formed on the surfaces of the fixing roller 31 and the pressure roller 32 is reduced.

That is to say, in the image forming apparatus 2 to which the present invention is applied, a sheet (recording material) on which an image is to be formed may be a continuous sheet or a long sheet as long as the sheet has a length in the transport direction longer than that of the transport module 100.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport module that is capable of being pulled out from an apparatus body of the image forming apparatus, wherein the transport module comprises a transport path configured to transport a recording material, to which a toner image has been transferred; and a fixing unit that is provided in the transport module, wherein the fixing unit comprises:

a fixing member configured to fix the toner image onto the recording material; and a pressure member, which forms a pressing part to which the recording material is to be transported between the fixing member and the pressure member, wherein, in the case where the recording material whose length in a direction in which the recording material is to be transported is longer than a length of the transport module is present in the transport path, the fixing unit is configured to switch to a pressed state, wherein the recording material is nipped by the fixing member and the pressure member, in response to at least one of:

the transport module being pulled out from the apparatus body, receiving a user instruction to clear a recording material jam, or a predetermined time passing after the fixing unit was switched to a released state, wherein the recording material is not nipped by the fixing member and the pressure member, in response to a recording material jam being detected.

2. The image forming apparatus according to claim 1, wherein the fixing unit is configured to switch to the pressed state in response to the transport module being pulled out from the apparatus body, and wherein the fixing unit is configured such that, after the transport module has been pulled out from the apparatus body in a state where the recording material is nipped by the fixing member and the pressure member, the fixing member and the pressure member are made to be spaced apart from each other.

3. The image forming apparatus according to claim 2, wherein, in the case where a continuous sheet is present as the recording material in the transport path, the image forming apparatus is configured to, in response to a recording material jam being detected, cut the continuous sheet at ends of the transport module, and after that, the transport module is pulled out from the apparatus body in a state where a portion of the continuous sheet, which has been cut, is nipped by the fixing member and the pressure member.

4. The image forming apparatus according to claim 1, wherein, in the case where a continuous sheet is present as the recording material in the transport path, the image forming apparatus is configured to, in response to a recording material jam being detected, cut the continuous sheet at ends of the transport module, and after that, the transport module is pulled out from the apparatus body in a state where a portion of the continuous sheet, which has been cut, is nipped by the fixing member and the pressure member.

5. The image forming apparatus according to claim 1, wherein the fixing unit is configured to switch to the pressed state in response to the transport module being pulled out from the apparatus body.

6. The image forming apparatus according to claim 1, wherein the fixing unit is configured to switch to the pressed state in response to receiving the user instruction to clear the recording material jam.

7. The image forming apparatus according to claim 1, wherein the fixing unit is configured to switch to the pressed state in response to the predetermined time passing after the fixing unit was switched to the released state in response to the recording material jam being detected.

8. The image forming apparatus according to claim 1, wherein the fixing unit is configured to switch to the released state in response to the recording material jam being detected.

9. An image forming apparatus comprising:

a transport module that is capable of being pulled out from an apparatus body of the image forming apparatus, wherein the transport module comprises a transport path configured to transport a recording material, to which a toner image has been transferred; and a fixing unit that is provided in the transport module, wherein the fixing unit comprises:

a fixing member, which is rotatable; and a pressure member, which forms a pressing part through which the recording material, to which the toner image has been transferred, passes between the fixing member and the pressure member, wherein, in a state where the recording material whose length in a direction in which the recording material is to be transported is longer than a length of the transport module is present in the transport path, the fixing unit is configured to switch to a pressed state, wherein the pressure member is kept pressed against the fixing member, in response to the transport module being pulled out from the apparatus body, and to remain in the pressed state until an amount of pulling of the transport module reaches a predetermined amount.

10. The image forming apparatus according to claim 9, wherein the fixing unit is configured to release the pressure member from a state of being pressed against the fixing member in response to the amount of pulling of the transport module reaching the predetermined amount.

11. The image forming apparatus according to claim 10, wherein the fixing unit is configured to, in response to a failure during transportation of the recording material occurring in the transport path, release the pressure member from a state of being pressed against the fixing member, and before starting an operation of pulling out the transport module from the apparatus body, press the pressure member against the fixing member.

12. The image forming apparatus according to claim 9, wherein the fixing unit is configured to, in response to a failure during transportation of the recording material occurring in the transport path, release the pressure member from a state of being pressed against the fixing member, and before starting an operation of pulling out the transport module from the apparatus body, press the pressure member against the fixing member.

13. An image forming system comprising:

a sheet feed device configured to feed a continuous sheet;

an image forming apparatus configured to form an image on the continuous sheet, which has been fed by the sheet feed device; and a collecting device configured to collect the continuous sheet, on which the image has been formed by the image forming apparatus, wherein the image forming apparatus includes:

a transport module that is capable of being pulled out from an apparatus body of the image forming apparatus, wherein the transport module comprises a transport path configured to transport the continuous sheet, to which a toner image has been transferred; and a fixing unit that is provided in the transport module, wherein the fixing unit comprises:

a fixing member configured to fix the toner image onto the continuous sheet; and a pressure member, which forms a pressing part to which the continuous sheet is to be transported between the fixing member and the pressure member, and wherein, in the case where the continuous sheet is present in the transport path, the fixing unit is configured to switch to a pressed state, wherein the continuous sheet is nipped by the fixing member and the pressure member, in response to at least one of:

the transport module being pulled out from the apparatus body, receiving a user instruction to clear a continuous sheet jam, or a predetermined time passing after the fixing unit was switched to a released state wherein the continuous sheet is not nipped by the fixing member and the pressure member, in response to a continuous sheet jam being detected.

14. The image forming system according to claim 13, wherein the fixing unit is configured to switch to the pressed state in response to the transport module being pulled out from the apparatus body, and wherein the image forming apparatus is configured such that the continuous sheet is pulled out from the sheet feed device or the collecting device as the transport module is pulled out from the apparatus body.

15. The image forming system according to claim 13, further comprising:

an upstream-side cutting device configured to cut the continuous sheet at a position upstream of the transport module; and a downstream-side cutting device configured to cut the continuous sheet at a position downstream of the transport module, wherein the image forming apparatus is configured to, in response to a continuous sheet jam being detected, cut the continuous sheet by the upstream-side cutting device and the downstream-side cutting device and, thereafter, the transport module is pulled out from the apparatus body in a state where a portion of the continuous sheet, which has been cut, is nipped by the fixing member and the pressure member.

16. The image forming system according to claim 13, wherein the fixing unit is configured to switch to the pressed state in response to the transport module being pulled out from the apparatus body.

17. The image forming system according to claim 13, wherein the fixing unit is configured to switch to the pressed state in response to receiving the user instruction to clear the continuous sheet jam.

18. The image forming system according to claim 13, wherein the fixing unit is configured to switch to the pressed state in response to the predetermined time passing after the fixing unit was switched to the released state in response to the continuous sheet jam being detected.

19. The image forming system according to claim 13, wherein the fixing unit is configured to switch to the released state in response to the continuous sheet jam being detected.

20. An image forming apparatus comprising:

a transport module that is capable of being pulled out from an apparatus body of the image forming apparatus, wherein the transport module comprises a transport path configured to transport a recording material, to which a toner image has been transferred; and a fixing unit that is provided in the transport module, wherein the fixing unit comprises:

a fixing member configured to fix the toner image onto the recording material; and a pressure member, which forms a pressing part to which the recording material is to be transported between the fixing member and the pressure member, wherein, in the case where the recording material whose length in a direction in which the recording material is to be transported is longer than a length of the transport module is present in the transport path, the fixing unit is configured to switch to a pressed state, wherein the recording material is nipped by the fixing member and the pressure member, in response to the transport module being pulled out from the apparatus body, and wherein the fixing unit is configured to, in response to a failure during transportation of the recording material occurring in the transport path, release the pressure member from a state of being pressed against the fixing member, and before starting an operation of pulling out the transport module from the apparatus body, press the pressure member against the fixing member.

* * * * *